US011383863B2

(12) United States Patent
Peterman et al.

(10) Patent No.: US 11,383,863 B2
(45) Date of Patent: Jul. 12, 2022

(54) ROBOTIC ARTICLE HANDLING SYSTEM AND OPERATIONS

(71) Applicant: Douglas Machine Inc., Alexandria, MN (US)

(72) Inventors: Thomas H. Peterman, Alexandria, MN (US); Christopher T. Davis, Alexandria, MN (US); Matthew D. Toyli, Parkers Prairie, MN (US); Aaron M. Frederick, Alexandria, MN (US); Richard W. Lukanen, Jr., Alexandria, MN (US); Christopher D. Harren, Sauk Centre, MN (US)

(73) Assignee: Douglas Machine Inc., Alexandria, MN (US)

( * ) Notice: Subject to any disclaimer, the term of this patent is extended or adjusted under 35 U.S.C. 154(b) by 722 days.

(21) Appl. No.: 15/756,111

(22) PCT Filed: Sep. 2, 2016

(86) PCT No.: PCT/US2016/050222

§ 371 (c)(1),
(2) Date: Feb. 28, 2018

(87) PCT Pub. No.: WO2017/041007

PCT Pub. Date: Mar. 9, 2017

(65) Prior Publication Data

US 2018/0244410 A1 Aug. 30, 2018

Related U.S. Application Data

(60) Provisional application No. 62/214,635, filed on Sep. 4, 2015.

(51) Int. Cl.
*B65B 5/06* (2006.01)
*B65B 35/36* (2006.01)

(52) U.S. Cl.
CPC ..... *B65B 5/06* (2013.01); *B65B 35/36* (2013.01); *B65B 2220/18* (2013.01)

(58) Field of Classification Search
CPC ..... B25J 9/0093; B25J 9/043; B65B 1/04; B65B 5/06; B65B 5/061; B65B 21/06;
(Continued)

(56) References Cited

U.S. PATENT DOCUMENTS 3,766,706 A 10/1973 Graham
4,608,808 A 9/1986 Ryan et al.
(Continued)

OTHER PUBLICATIONS https://www.indiamart.com/proddetail/scara-4-axis-articulated-6-axis-and-delta-robots-15177092573.html (Year: 2017).*
(Continued)

*Primary Examiner* — Saul Rodriguez
*Assistant Examiner* — Brendan P Tighe
(74) *Attorney, Agent, or Firm* — Dicke, Billig & Czaja PLLC

(57) ABSTRACT

A top loading assembly is provided. The assembly includes a robotic arm and an article collector assembly supported thereby. The robotic arm is characterized by first and second arm segments and three pivotable arm joints, a first arm joint J1 being a distal arm joint for operatively supporting said collector assembly, a second arm joint J2 being an intermediate arm joint, and a third arm joint J3 being a terminal/anchorable arm joint. The collector assembly, directable from an article collection locus to a collected article loading locus, includes a collector adapted to effectuate select clamping in relation to articles collected by the collector during direction of the collector assembly from the article collection locus to the collected article loading locus.

27 Claims, 16 Drawing Sheets

(58) Field of Classification Search
CPC ..... B65B 35/30; B65B 35/36; B65G 47/901; B66C 1/30; B66C 1/48; Y10T 83/2037
USPC ..... 53/147, 247, 447
See application file for complete search history.

(56) References Cited

U.S. PATENT DOCUMENTS

| | | | |
|---|---|---|---|
| 4,850,627 | A | 7/1989 | Franklin |
| 4,976,582 | A | 12/1990 | Clavel |
| 5,178,506 | A | 1/1993 | Meschi |
| 6,122,895 | A | 9/2000 | Schubert |
| 6,619,014 | B2 | 9/2003 | Muller |
| 6,860,531 | B2 | 3/2005 | Sherwin |
| 7,018,163 | B2 | 3/2006 | Beavers et al. |
| 7,069,708 | B2 | 7/2006 | Ishii et al. |
| 7,216,470 | B2 | 5/2007 | Nishida |
| 7,587,879 | B2 | 9/2009 | Guttinger et al. |
| 7,788,885 | B2 | 9/2010 | Sandberg et al. |
| 7,789,226 | B2 | 9/2010 | Carrigan et al. |
| 7,856,797 | B2 | 12/2010 | Black et al. |
| 8,322,537 | B2 | 12/2012 | Lindee |
| 8,627,941 | B2 | 1/2014 | Lindee |
| 8,689,530 | B2 | 4/2014 | Prahm et al. |
| 2006/0053754 | A1 | 3/2006 | Carrigan et al. |
| 2009/0249750 | A1 | 10/2009 | Black et al. |
| 2011/0173930 | A1 | 7/2011 | Poutot |
| 2012/0006651 | A1 | 1/2012 | Cote |
| 2012/0232690 | A1* | 9/2012 | Gilchrist ..... H01L 21/67706 700/228 |

OTHER PUBLICATIONS https://www.shgongboshi.com/sale-12121341-collaborative-scara-chinese-robot-arm-welding-7-axis-industrial-kit-white-color.html (Year: 2020).*
https://www.generationrobots.com/en/403474-hebi-robotics-4-dof-scara-arm-assembled-and-tested.html (Year: 2017).*
https://www.youtube.com/watch?v=dyyy0KqIUcE&feature=emb_logo (Year: 2017).*
International Search Report and Written Opinion from PCT/US16/50222 (8 pages); Lee W. Young; dated Nov. 28, 2016.
International Preliminary Report on Palatability from PCT/US16/50222 (16 pages); Saul Rodriguez; dated Dec. 15, 2017.

* cited by examiner

ROBOTIC ARTICLE HANDLING SYSTEM AND OPERATIONS

CROSS-REFERENCE TO RELATED APPLICATIONS

This utility patent application is a U.S. National Stage filing under 35 USC § 371 of application Serial No. PCT/US2016/050222, filed Sep. 2, 2016, which is an international patent application filed under 35 USC § 363 claiming of priority under 35 USC § 120 of/to U.S. Pat. Appl. Ser. No. 62/214,635, filed Sep. 4, 2015, incorporated by reference in its entirety.

TECHNICAL FIELD

The present invention generally relates to article handling and/or packing operations, namely, to one or more of systems, apparatuses, assemblies, subassemblies, and/or methods for/of article manipulation in furtherance of executing further processing steps on the article or an article group formed via article manipulation. More particularly, the instant disclosure is directed to an improved robotic article handling assembly and system so characterized for, by way of non-limiting example, article collection and top load robotic case packing, advantageously but not exclusively, the trackless top loading of selectively aggregated/grouped articles.

BACKGROUND

Various mechanisms are known to effectuate, among other article handling operations, the grouping/packaging of articles from a source of flowing articles in a top load fashion. Having generally evolved from Ferris wheel type apparatus and/or track mounted rotating "buckets" (see e.g., U.S. Pat. No. 3,766,706 (Graham)) top load case packers are presently and commonly characterized by industrial robots.

Industrial robots are automatically controlled, reprogrammable, multipurpose manipulators programmable in three or more axes (International Organization for Standards, ISO 8373). Commonly, such "manipulators" are categorized by the number of independent parameters that define its configuration, i.e., its degree of freedom. Two degrees of freedom, or axes, are required to reach any point in a plane (i.e., area), with three axes required to reach any point in space (i.e., volume). Once positioned at a designated point, orientation control requires three further axes, i.e., yaw, pitch and roll.

The region of space within which a robot operates, more particularly, the region it can reach, is referred to as the robot's working envelope. The arrangement of the rigid member(s) and joints of the robot determine its range of motion (i.e., kinematics), common types being articulated, cartesian, parallel, and SCARA (Selective Compliance Assembly Robot Arm). As to attributes, form fits function in connection to the further defining robotic parameters of carrying capacity (i.e., payload), speed, acceleration, accuracy, and repeatability.

Parallel delta type robots, i.e., those having their origins in the teaching of Clavel (U.S. Pat. No. 4,976,582) and generally characterized by three arms connected to a universal joint, or other functionally equivalent pick-and-place mechanisms, e.g., multi-axis servo pickers/loaders, have been widely utilized for individual article operations and/or manipulations. Moreover, SCARAs, characterized by an arm rigid in the z-axis and pliable in the x, y-axes, have likewise been utilized for individual article operations and/or manipulations. With regard to the collection or grouping of articles and subsequent top loading of the article group to/into a case, articulated kinematics are commonly utilized.

Illustrative of article handling operations characterized by the accumulation, aggregation and/or grouping of articles such as bags, pouches, cartons, etc. and their subsequent top case loading, are the teachings of Black et al. (U.S. Pat. No. 7,856,797) and Cote (US Pub. No. 2012/0006651). Essentially, a floor mounted articulated arm is positioned proximal to an inflow of individual articles and one or more cases from a supply of cases such that its working envelope includes an article ingress local and a grouped article egress local. The former teaching is characterized by, among other things, a single articulated arm operable between ingress and egress locals which are adjacent one another, the arm essentially pivoting left and right while executing desired operations. The later teaching is characterized by, among other things, a pair of spaced apart articulated arms intermediate ingress and egress locals, the arms thusly rotating between upstream and downstream points during transfer operations.

In-as-much as these representative teachings disclose advantageous features, such articulated arm solutions are not without their shortcomings and/or drawbacks. For instance, and without limitation, articulated arms are expensive; articulated arms require appreciable, robust support/anchoring; articulated arms are not readily configurable, reconfigurable, and/or located/relocated; and, articulated arms occupy appreciable floor plan owing to the nature of their working envelope (i.e., accommodation of the articulation). Thus, there remains a need for improved robotic handling operations, e.g., improved article handling operations characterized by the accumulation, aggregation and/or grouping of articles such as bags, pouches, cartons, etc. and their subsequent top case loading. More particularly, it is believed advantageous to provide a turnkey, modular system of minimal footprint characterized by, among other things, one or more of a lower robot axes count, increased capacity or payload, greater handling speed/throughput, greater versatility via change parts and ease of change part conversion, an improved article ingress approach angle for an end effector, advantageously, one part and parcel of a supremely efficient travel path, and, improved system controls for maintaining the efficient travel path relative to article infeed operations and/or loaded case egress operations.

SUMMARY OF THE INVENTION

A top loading assembly is provided. The assembly includes a robotic arm and an article collector assembly supported thereby. The robotic arm is characterized by first and second arm segments and three pivotable arm joints, a first arm joint J1 being a terminal/anchorable arm joint, a second arm joint J2 being an intermediate arm joint, and a third arm joint J3 being a distal arm joint for operatively supporting the collector assembly. The collector assembly, directable from an article collection locus to a collected article loading locus, includes a collector adapted to effectuate select two dimensional clamping in relation to articles collected by the collector during direction of the collector assembly from the article collection locus to the collected article loading locus.

Advantageously, the collected article loading locus is neither upstream nor to a side of the article collection locus. Moreover, robotic arm joint J1 is preferably, but not necessarily, a downstream most robotic arm joint. Further still, it is believed advantageous, but hardly necessary to locate J1 in substantial elevational alignment with the article collection locus. Yet further still, the robotic arm is advantageously, but hardly necessarily, actuatable to effectuate either of a convex or concave upper upstream travel segment for the collector of the collector assembly during an approach to the article collection locus.

Advantageously, the article collector assembly includes dual clamps and a clamp base characterized by clamp actuators for actuating the dual clamps, the dual clamps delimiting the collector. Preferably, but not necessarily, the dual clamps are change parts, amenable to swift tool-less change out. Moreover, and alternately, the collector may include at least a single side clamp to effectuate side-to-side article group clamping, the at least a single side clamp may be further adapted for pivoting to enhance article ingress to the collector, and a top clamp to effectuate top-to-bottom article group clamping, the top clamp, as the at least a single side clamp, may be further adapted for pivoting to enhance article ingress to the collector.

In an alternate embodiment, the collector includes opposingly paired lateral members and a top member, the members delimiting an adjustable article receiving volume. Moreover, the assembly further includes a collector actuator subassembly operatively linked to at least one lateral member of the opposingly paired lateral members to effectuate translation thereof. Further still, the collector actuator subassembly may be operatively linked to the lateral side members and the top member to effectuate select translations of same in furtherance of two dimensional clamping of a collected article group, either or both of the collector actuator subassembly and top member readily adapted to enable pivoting of the top member to enhance article ingress to the collector.

Finally, a method of case loading articles is provided. Articles of an article infeed supply are directed to an article collection locus, with provisions made for a case loading assembly proximal to the article collection locus. The case loading assembly includes a robotic arm and an article collector assembly supported thereby, the robotic arm characterized by first and second arm segments and three pivotable arm joints. The article collector assembly is directable from the article collection locus to a collected article loading locus, the collected article loading locus being neither upstream nor to a side of the article collection locus. The collector assembly includes a collector adapted to effectuate select clamping in relation to articles collected by the collector. Articles are collected via the collector of the article collector assembly at the article collection locus, a portion of the collector having been actuated to enhance article ingress into the collector. A collected article group is retained within the collector of the article collector assembly, portions of the collector having been actuated to effectuate clamping of the collected article group during travel of the article collector assembly from the article collection locus to the collected article loading locus. More specific features and advantages obtained in view of those features will become apparent with reference to the drawing figures and DETAILED DESCRIPTION OF THE INVENTION.

BRIEF DESCRIPTION OF THE DRAWINGS & DEPICTIONS THEREOF

FIG. 1 generally depicts top loading operations, perspective side view process flow left to right, via an exemplary top loading assembly;

Figure 15:
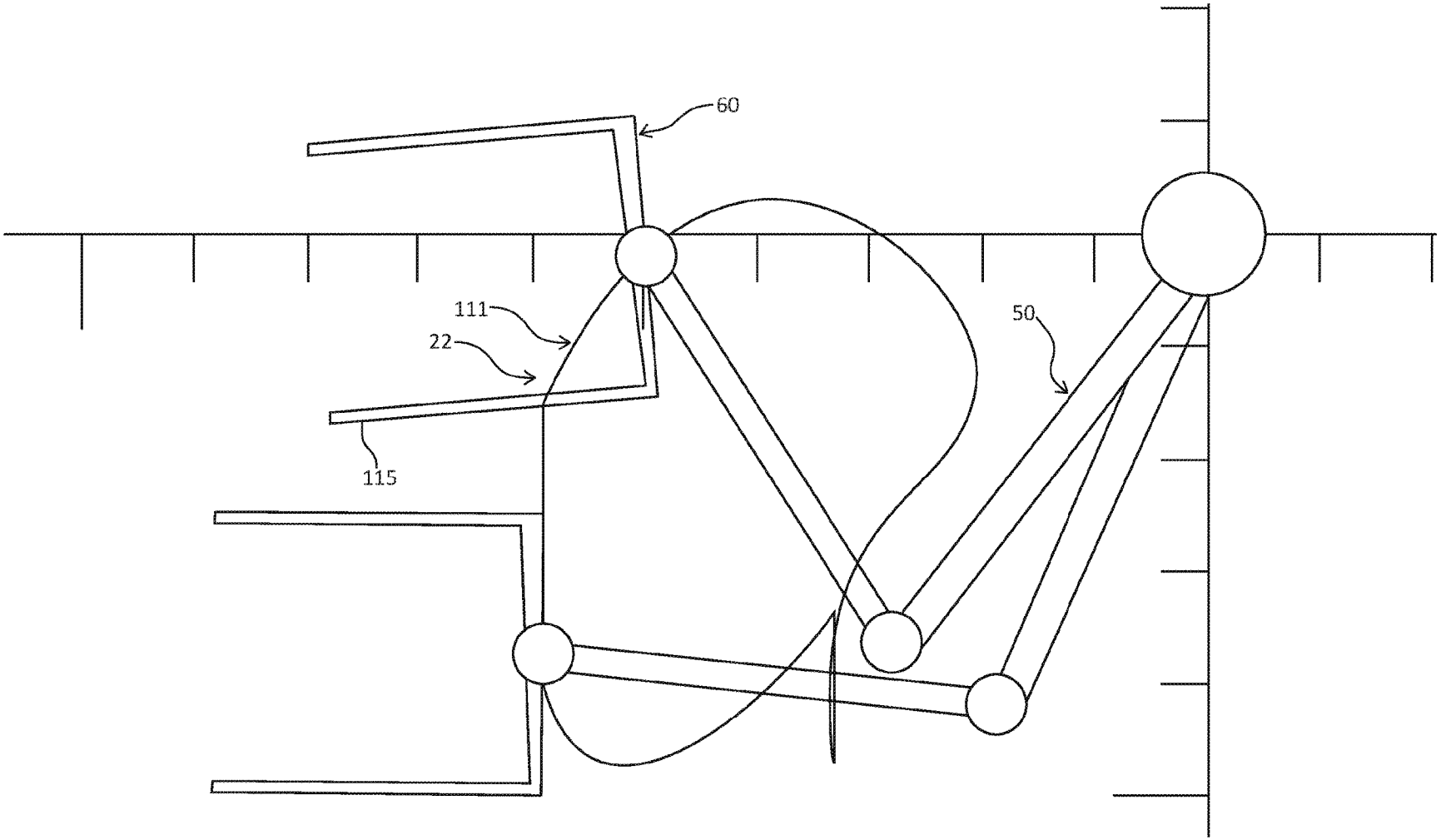
Figure 16:
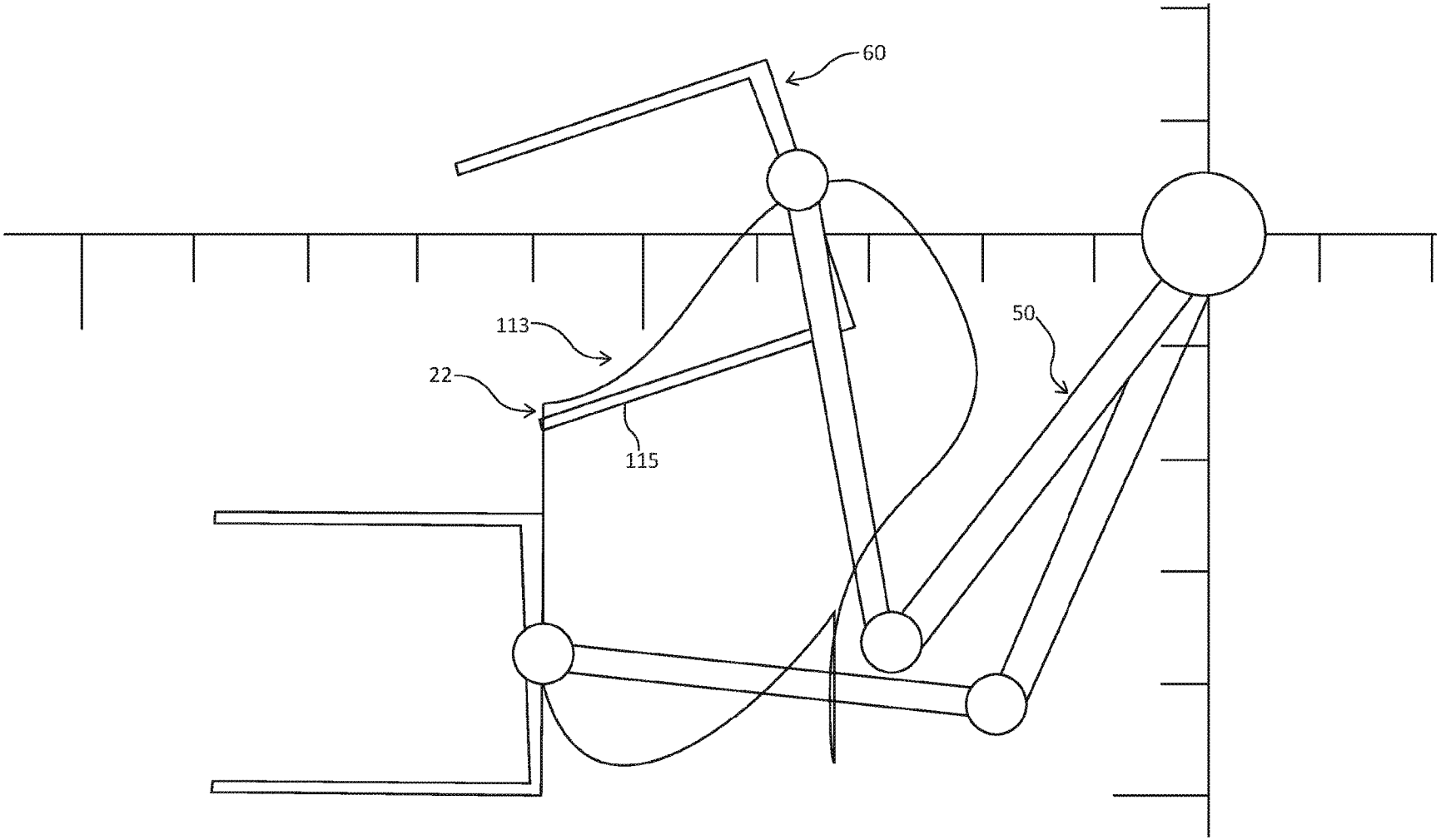

FIG. 15 depicts an x-y (side elevation) travel path of a distal arm joint of the robotic arm of the assembly, the travel path characterized by a concave upper upstream travel segment for the collector of the collector assembly during an approach to the article collection locus; and, FIG. 16 depicts an alternate x-y (side elevation) travel path of a distal arm joint of the robotic arm of the assembly, the travel path characterized by a convex upper upstream travel segment for the collector of the collector assembly during an approach to the article collection locus.

All figures have been prepared to facilitate and/or enhance an understanding of the basic teachings of the present invention, and/or the concepts underlying same. Extensions of the figures with respect to number, position, relationship, and dimensions of the parts to form one or more preferred embodiments or variants thereof may be explained or is understood to be within the skill of the art after the following description has been read and understood.

DETAILED DESCRIPTION OF THE INVENTION

Figure 1:
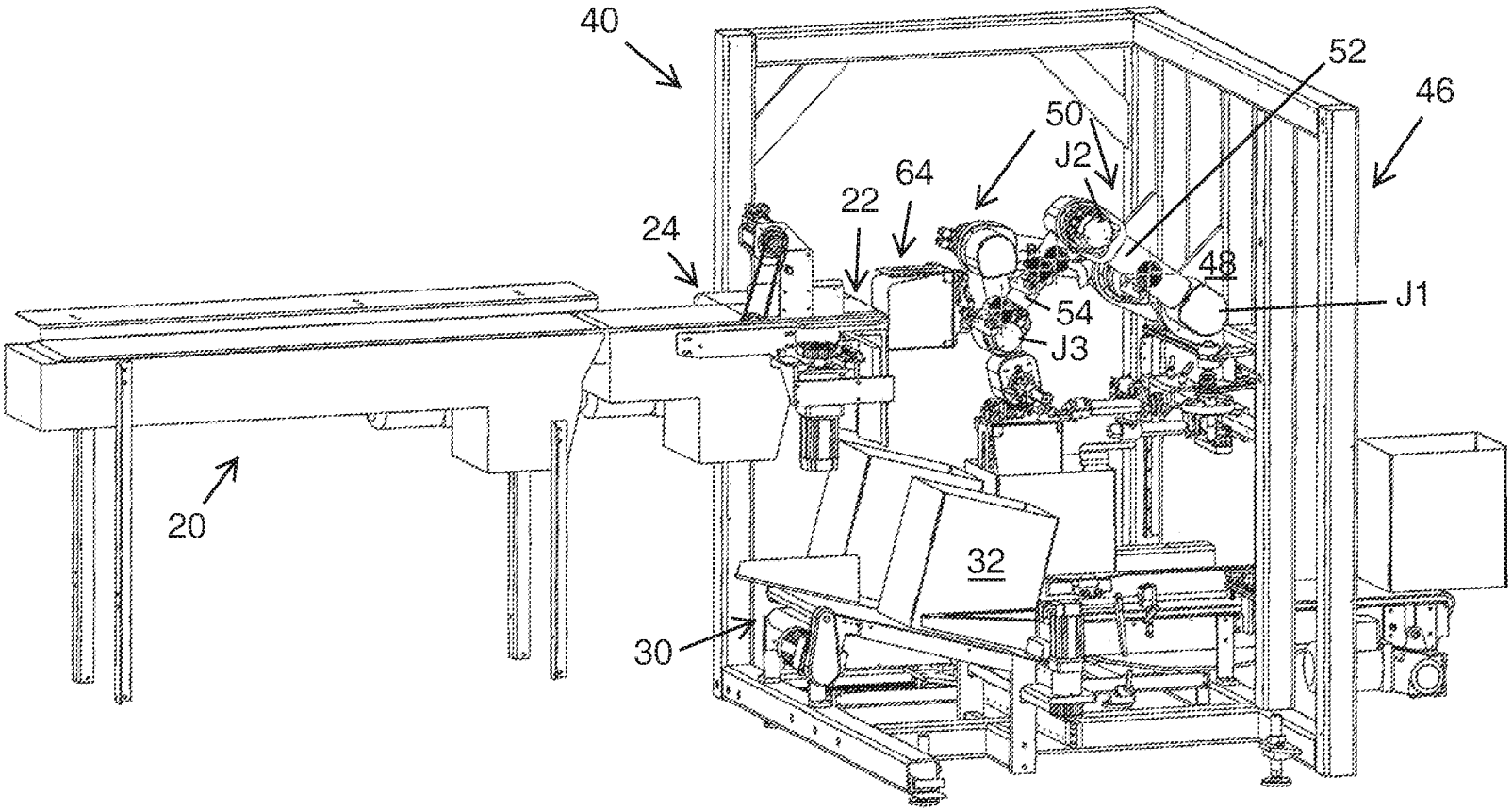
Figure 8:
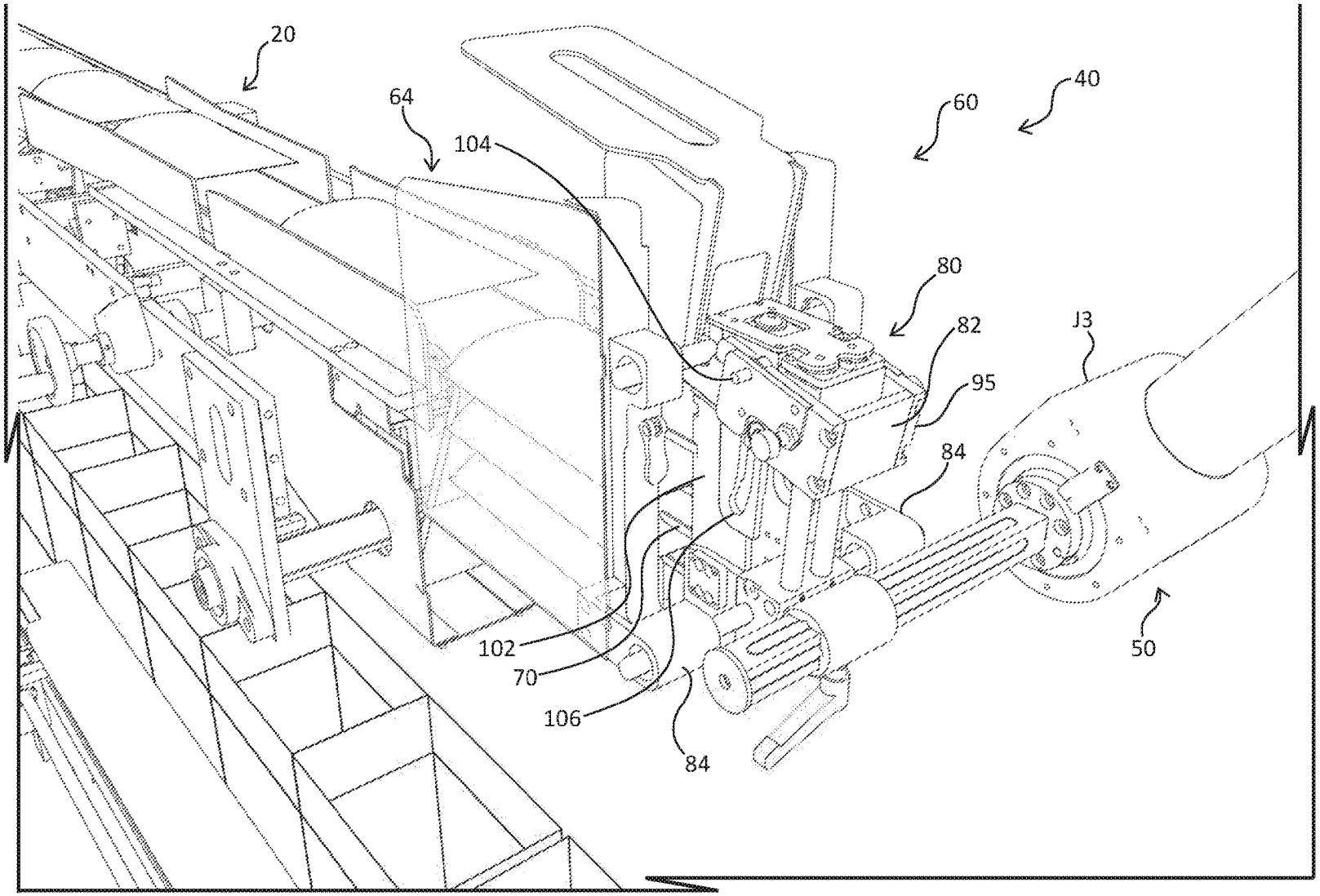
FIG. 8 depicts, perspective upstream view from the rear, the article collector assembly in a full open configuration for article receipt at the article collection locus.
Figure 9:
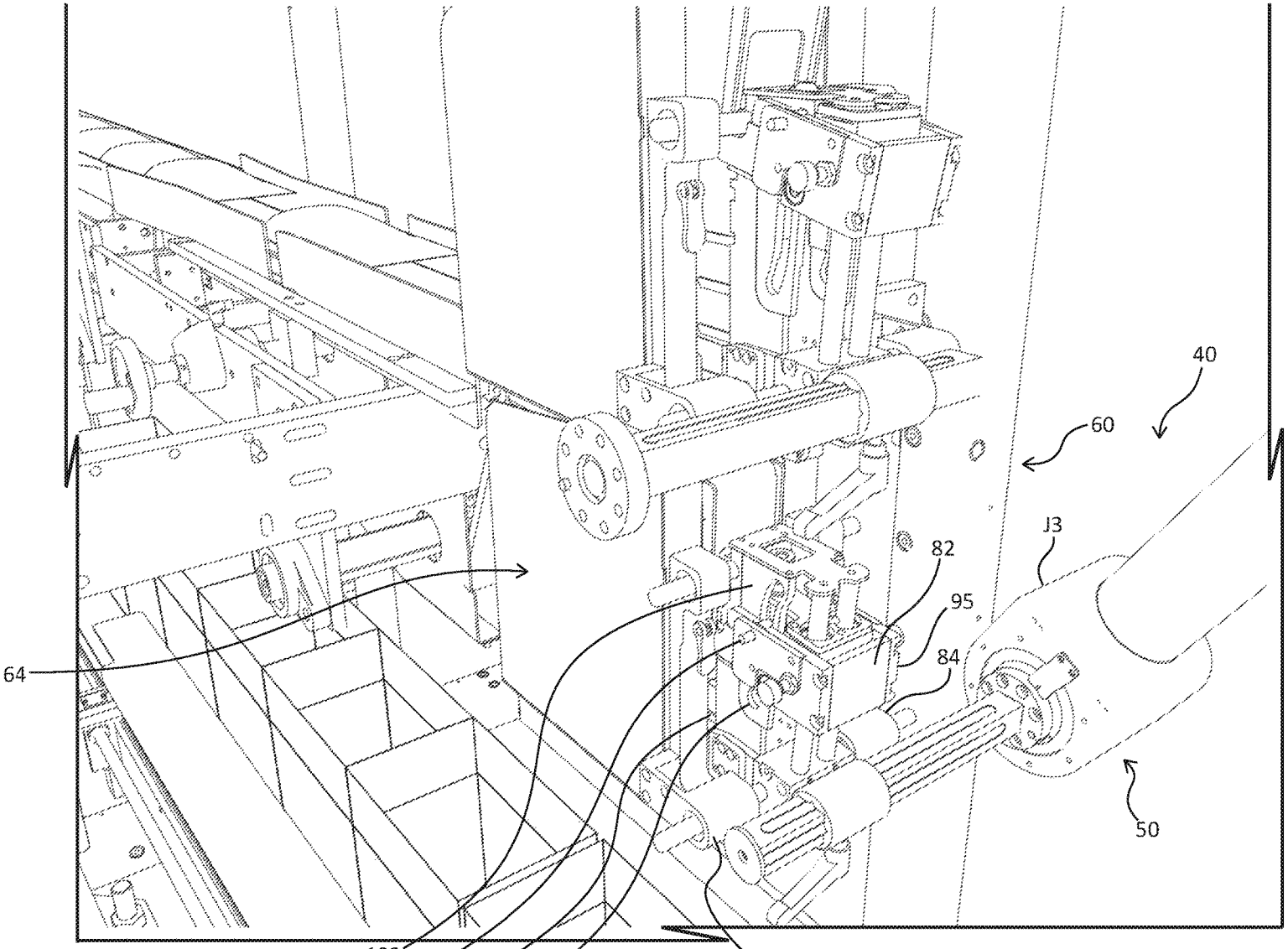
FIG. 9 depicts the article collector assembly of FIG. 8 at a later time, the collector of the article collector assembly in a "clamped" configuration for collected article retention.
Figure 10:
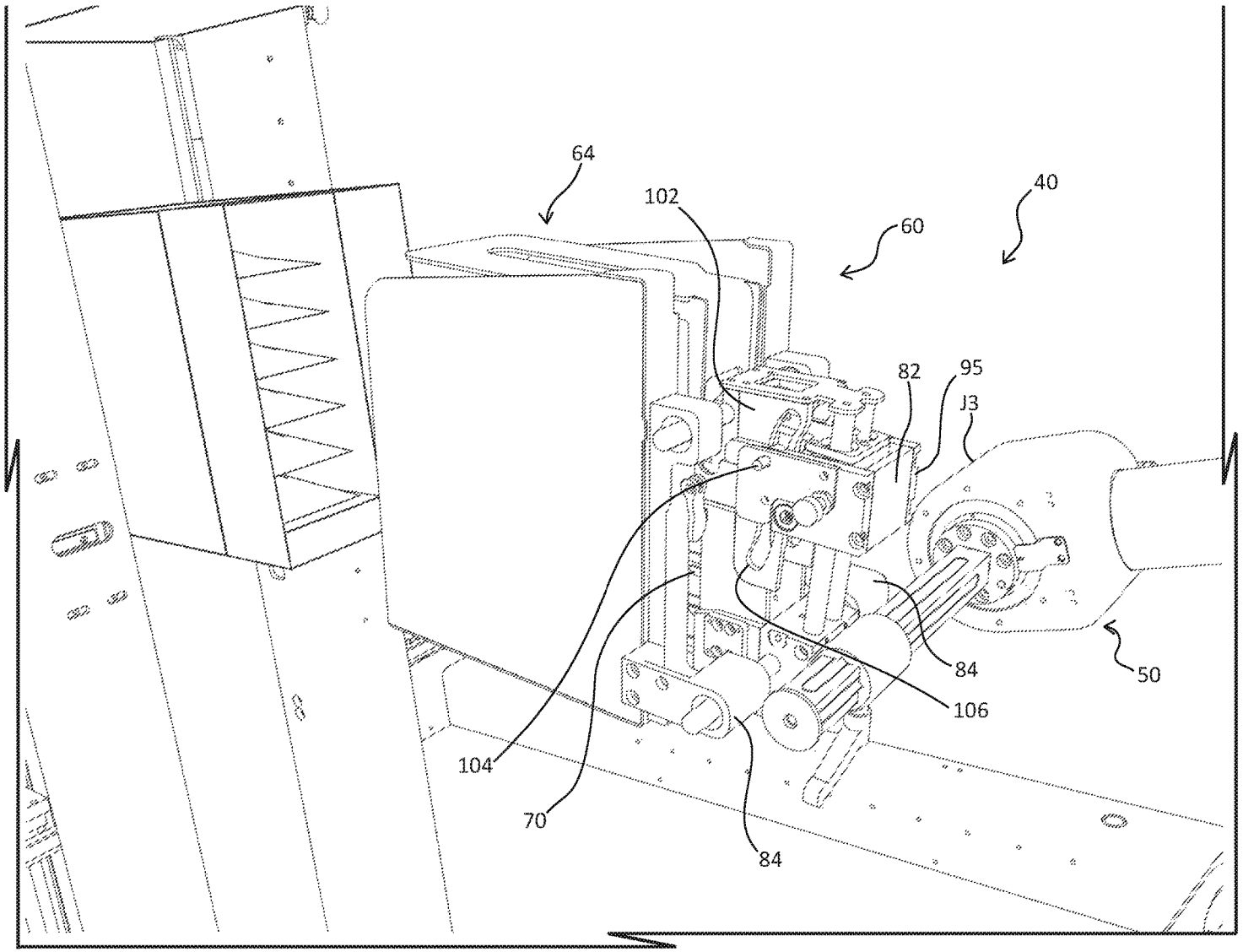
FIG. 10 depicts the article collector assembly of FIG. 9 at a later time, the article collector assembly in a partial open configuration post collected article off-loading.

Preferred, non-limiting assemblies, structures and/or mechanisms relating to and for improved article collating and/or collating and loading are generally disclosed and presented throughout the figures of the subject disclosure. An advantageous, representative, non-limiting top loading assembly is generally depicted in FIG. 1 and the attendant views of FIGS. 2 & 3. An especially advantageous article collector assembly (i.e., a subassembly of the top loading assembly), parts omitted for the sake of clarity, is depicted in FIG. 4 and the attendant views of FIGS. 5 & 6, with an advantageous non-limiting collector actuator subassembly illustrated in FIG. 7. Functional configuration combinations with regard to the article collector assembly (i.e., the collector per se and the collector actuator subassembly) are illustrated in FIGS. 8-10, with illustrative, non-limiting advantageous travel paths for the article collector assembly shown in FIGS. 15 & 16. Finally, an operational top loading sequence is illustrated in FIGS. 11-14.

Prior to subject matter particulars, some initial observations and/or comments are warranted. The assemblies, structures and/or mechanisms (or configurations of any of same as the case may be) hereinafter described prove especially advantageous in connection to top load case packing, more particularly still, in connection to top load standup configuration packing, however, they should not be viewed as so limited. Moreover, case loading of doy, pillow, and flat bottom bags and pouches are contemplated, though case loading is not so limited. While article collating operations are set forth in connection to a "top-seal-leading" collector ingress, such article presentation/infeed need not be so limited.

Article or product receiving, pack collation (i.e., article grouping), and case loading functions are effectuated via a robust article collector assembly of the top loading assembly. Characteristic of the collector assembly is a collector adapted to effectuate select 2D grasping or clamping of collected articles, and thus pattern (i.e., article group) containment. Single and multiple product facing options are contemplated and readily achievable via quick assembly change parts, for example, clamp elements which delimit the collector.

The article collector assembly is operatively supported by a robotic arm, advantageously, a SCARA. In-as-much as single or multiple arm assemblies are contemplated, dual arm assemblies are generally shown herein. Moreover, while a collector is essentially adjacent or proximal to an article collection locus (e.g., an article infeed egress), a fixed end for the SCARA may be suitably anchored up or downstream of the article collector locus, and/or at an elevation above, at, or below the article collector locus. Via the contemplated SCARA arrangement and/or configuration, increased simplicity and efficiencies are attained, e.g., a compact footprint commensurate with a tight SCARA working envelope, precise article handling archived, fewer and easier adjustments had, high payloads and speed obtained, unparalleled machine accessibility gained, and gantry type belts, bearings, pulleys or vacuum eliminated without loss of functionality.

Figure 2:
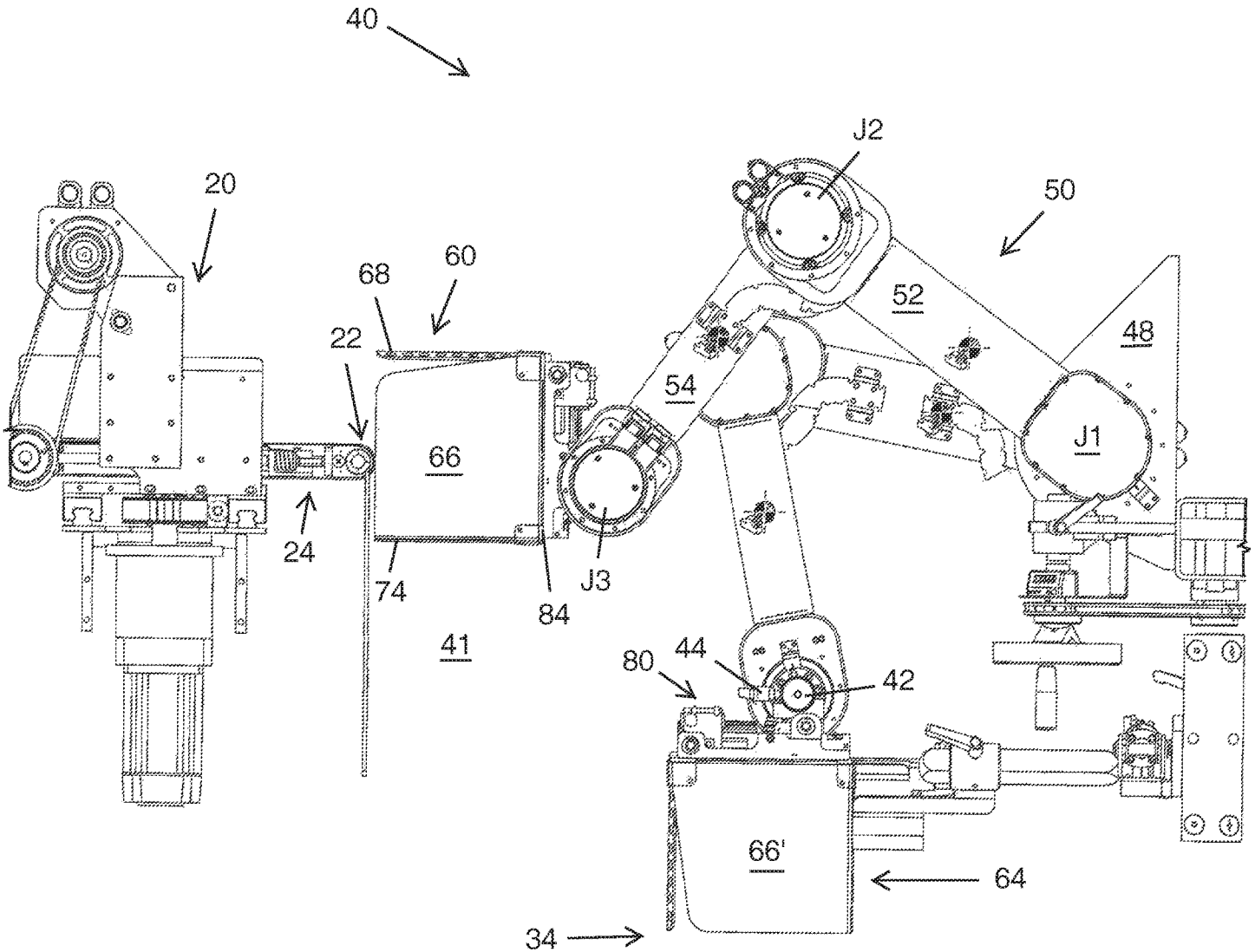
FIG. 2 depicts, side elevation, the top loading assembly of FIG. 1.
Figure 3:
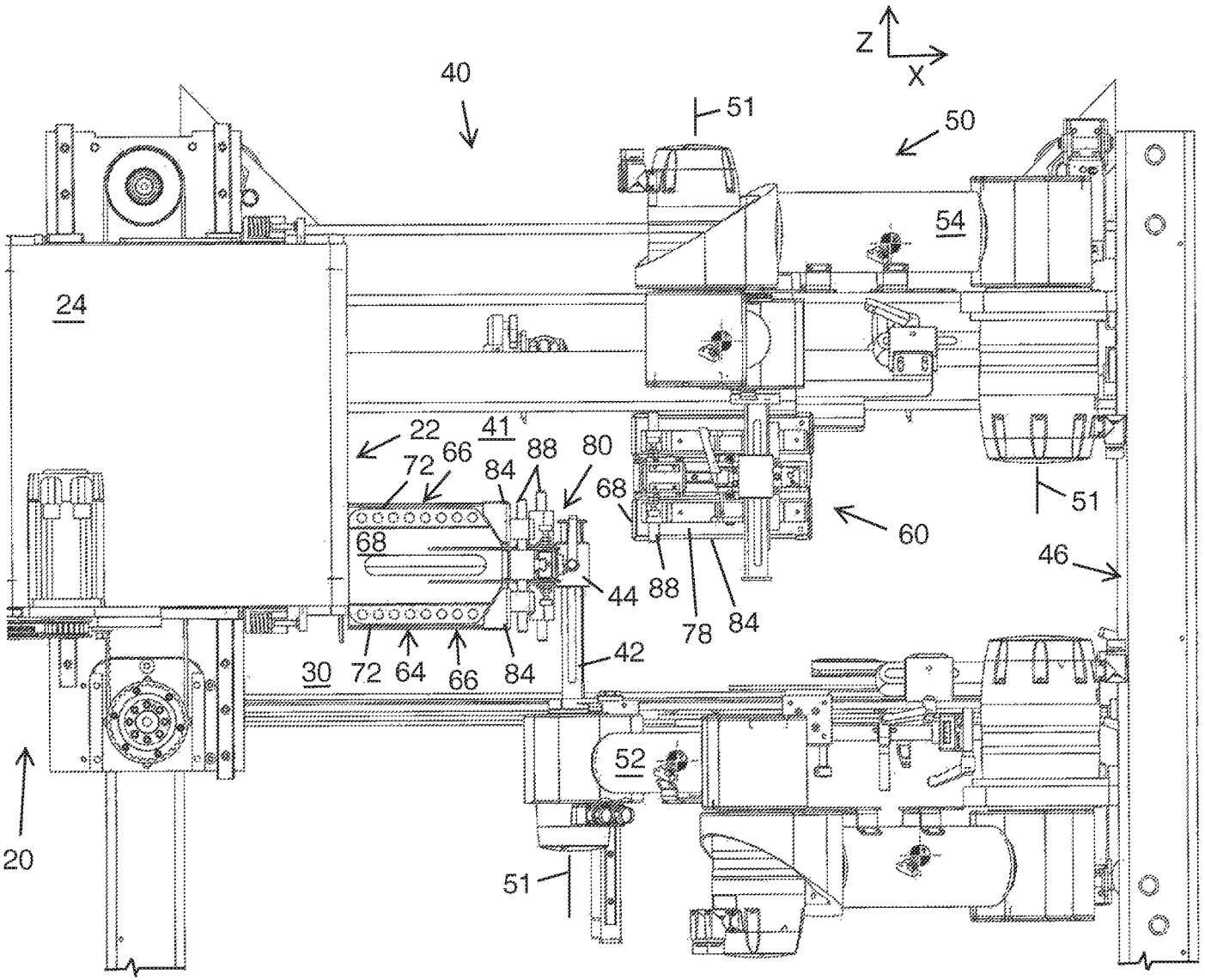
FIG. 3 depicts, overhead plan, the top loading assembly of FIG. 2, non-operational collector alignment.
Figure 4:
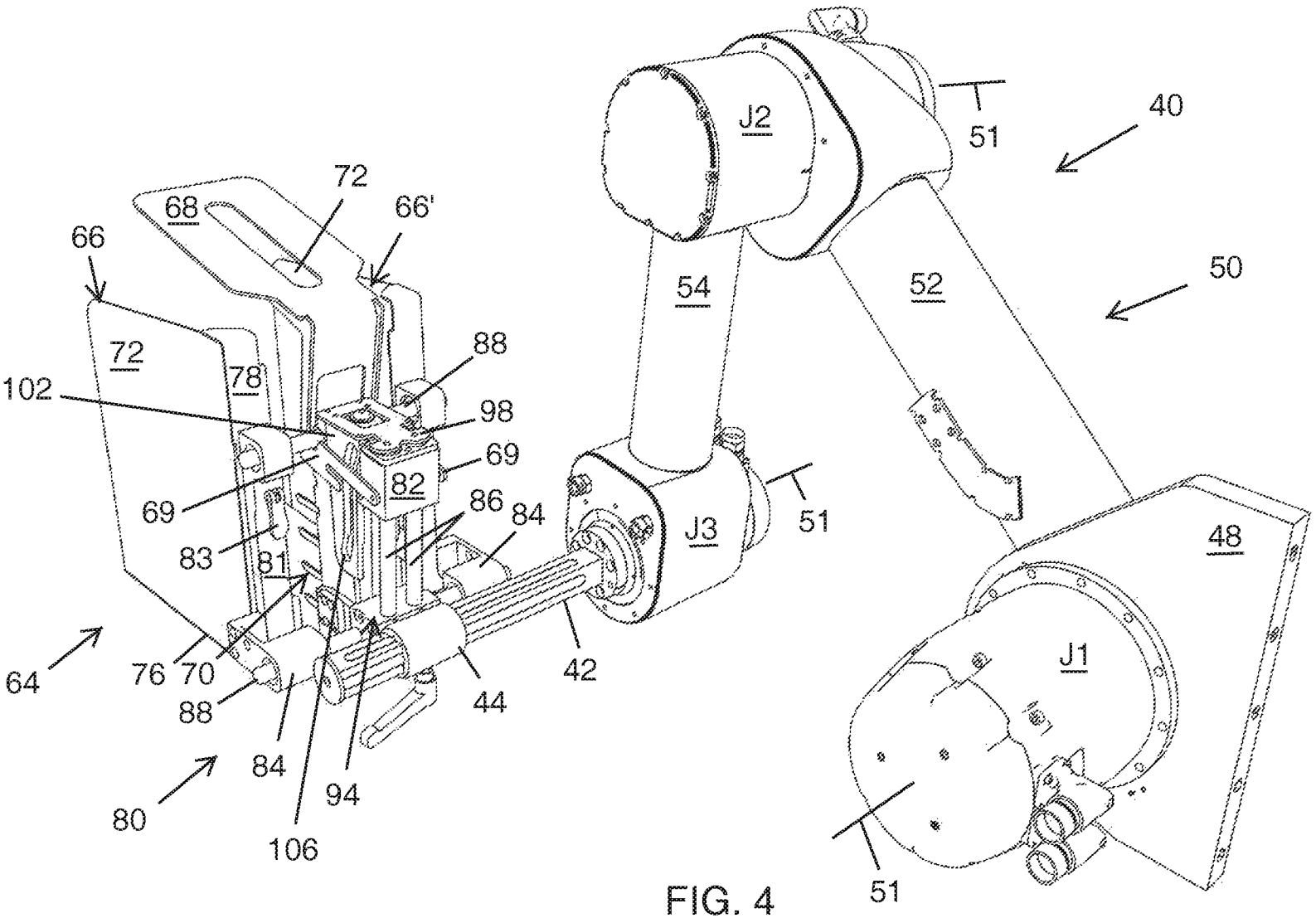
FIG. 4 depicts in combination, perspective upstream side view, a robotic arm and article collector assembly, the collector assembly configured for article receipt, portions of a collector actuator subassembly thereof omitted for the sake of clarity.

Referring initially to FIG. 1 of FIGS. 1-3, there is shown an improved robotic handling system, namely, a top loading case packer assembly 40 intermediate an article infeed conveyor 20 and a case presenter/conveyor 30, process flow left to right. Notionally, the top loading assembly is characterized by a robotic arm 50 and an article collection assembly 60 supported thereby, advantageously as shown, but not necessarily, a pair of similarly equipped robotic arms are provided, i.e., each of first 50 and second 50' robotic arms operatively supports an article collection assembly 60, 60'.

As is generally well established and known, articles (not shown) travel in spaced apart condition upon infeed conveyor 20 toward a free end thereof which, for the sake of discussion, generally delimits an article collection locus 22. Articles may be suitably manipulated via a product placement conveyor (PPC), i.e., a divider conveyor 24, or the like in furtherance of discharging transversely displaced articles (see e.g., Applicant's U.S. Pub. No. US 2013/008762), i.e., articles of the infeed conveyor may be gapped or gapped and divided as circumstances warrant, a side-by-side article packing thereby effectuated as to the latter process. Cases 32 are generally conveyed to pass below the top loading case packer assembly, intermittently or otherwise, for loading at a collected article loading locus 34 and subsequent take-away for further processing (e.g., closure).

Notionally, article collection assembly 60 is directable, via its robotic arm 50, to and from the article collection locus 22 to collected article loading locus 34. The collected article loading locus is advantageously, but not necessarily, neither upstream nor to a side of the article collection locus. Article collection assembly 60 includes a collector 64 adapted to effectuate select two dimensional clamping in relation to articles collected by the collector during direction of the collection assembly from the article collection locus to the collected article loading locus.

With particular reference now to FIGS. 2-4, each robotic arm 50, 50' of top loading assembly 40 of FIG. 1 is characterized by first 52 and second 54 arm segments, and three pivotable arm joints J1, J2, & J3. A first pivotable arm joint (J1) is a terminal/anchorable arm joint (i.e., the robotic arm depends from J1). A second pivotable arm joint (J2) is an intermediate arm joint. A third pivotable arm joint (J3) is a distal or free-end arm joint which operatively supports article collection assembly 60 via a splined shaft 42 or the like (FIGS. 3 & 4), collection assembly fixedly supported in relation to shaft 42 via a clampable coupling 44 (FIGS. 3 & 4).

As best appreciated with reference to FIG. 4, each of joints J1-J3 are selectively rotatable about an axis of rotation 51 to effectuate x-y positioning of J2 & J3, more particularly, x-y positioning of the axis of rotation of each of joints J2 & J3 (see e.g., FIG. 2). Although not shown, it should be readily appreciated that the contemplated robotic arm of the instant assembly be suitably mounted at or proximal to J1 for motion, e.g., translation or rotation.

First arm segment 52 (i.e., an upper arm or "humerus" segment) extends between J1 ("shoulder") & J2 ("elbow"). Second arm segment (i.e., a lower arm or "forearm" segment) extends between J2 (elbow) & J3 (i.e., wrist). As should be readily appreciated, each robotic arm 50, 50' is operatively supported within a structural assembly or frame 46 by or at J1, i.e., J1 is supported upon/by a frame member 48 for rotation, so as to depend therefrom (FIG. 3).

With continued reference to FIGS. 2-4, and particular reference to FIG. 2, each robotic arm 50, 50' is shown as extending/being extendable in an upstream process flow direction. More particularly, it is preferred and believed advantageous, but hardly necessary, that J1 be a downstream most arm joint, and more particularly still, that J1 be a downstream most arm joint positioned to be substantially opposite the article collection locus (i.e., J1 is preferably but not necessarily in substantial elevational alignment with article collection locus 22 (FIG. 2)). That said, the robotic arms may be configured and/or arranged such that J2 may be a downstream most arm joint. Moreover, in addition to process flow direction relationships for, between and among J1 & J2, vertical or elevational relationships are to be noted. More particularly, and by way of non-limiting illustration, the robotic arms may be configured and/or arranged such that J1 is "above" J2 (e.g., the robotic arm may depend from an overhead structural member (e.g., horizontal support)) such that arm segment two extends/is extendable in a downward direction). Contrariwise, J2 may be "above" J1 as is generally shown (FIG. 2), the robotic arm depending from a support at an elevation generally below or lower than the article collection locus. However, there may be arrangements wherein the robotic arm depends from a support at an elevation generally above the article collection locus with J2 nonetheless in an elevated condition relative to J1 during article collection by the collector at the article collection locus. In short, it is to be appreciated that numerous relational permutations are available for the robotic arm joints in relation to each other and the infeed, more particularly, the article collection locus, of the contemplated assembly, for example: J1 below the locus, J2 up or down in relation thereto; J1 above the locus, J2 up or down in relation thereto; and, J1 substantially level with the locus, J2 up or down in relation thereto.

With continued reference to FIGS. 2-4, and particular reference to FIG. 3, robotic arms 50, 50' are shown in spaced apart condition, a working envelope 41 generally delimited therebetween (z-direction), namely, a transverse width for same. Via an indirect union of article collection assembly 60 to/with the free end of robotic arm 50, collectors 64, 64' of article collector assemblies 60, 60' may be suitably offset transversely so as to be appropriately positioned in connection to each of article collection locus 22 and the collected article loading locus 34. It should be appreciated that, contrary to their depiction, the x-direction center lines for the article collection assemblies, more particularly the collectors are axially aligned during machine operation/processing.

Figure 5:
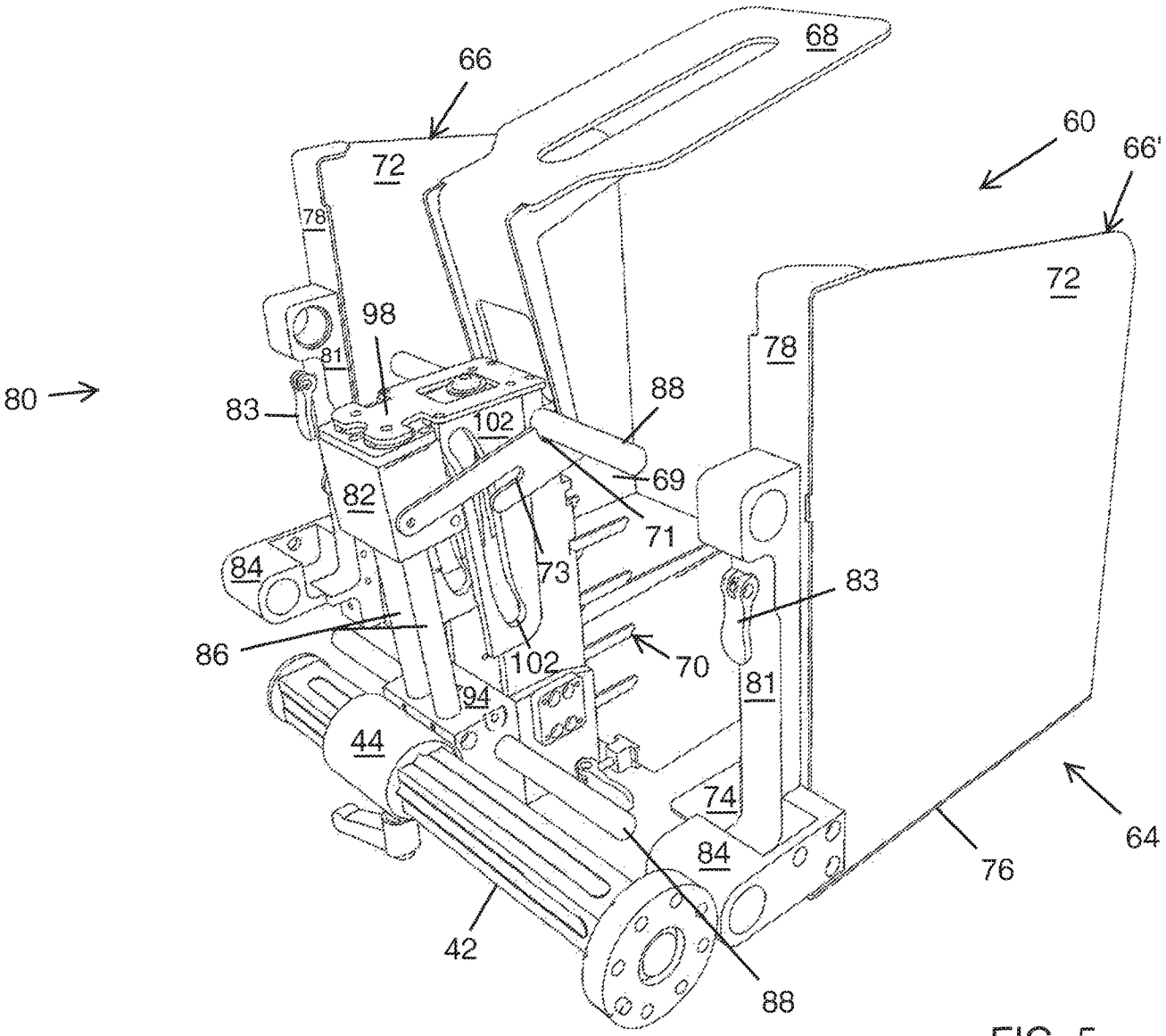
FIG. 5 depicts, exploded perspective rear view, the collector assembly of FIG. 4.
Figure 6:
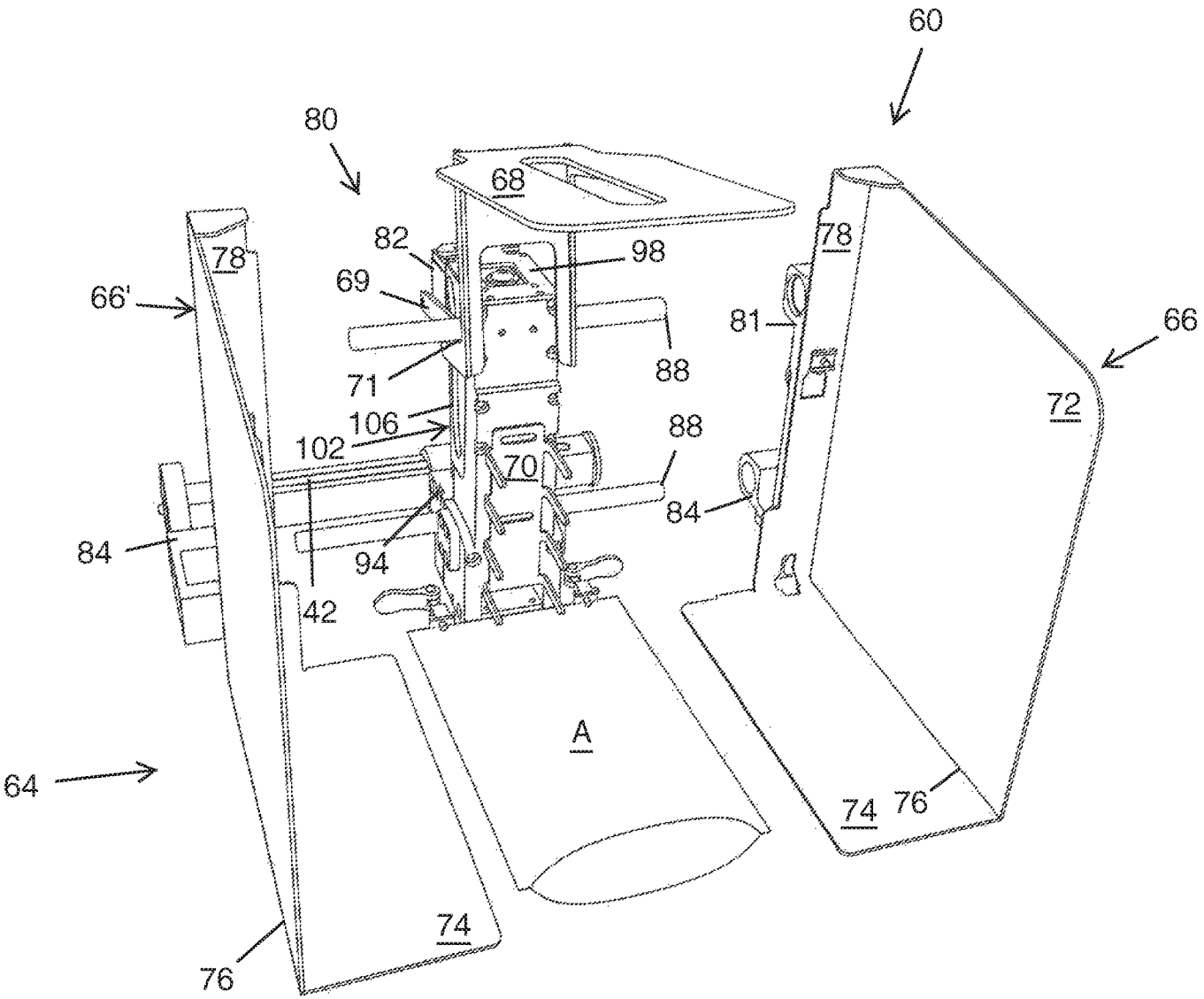
FIG. 6 depicts, exploded perspective front view, the collector assembly of FIG. 4.

With continued general reference now to FIGS. 4-6, particulars are shown for a preferred, non-limiting article collector assembly for the top loading assembly of FIG. 1. Article collection assembly is generally and fairly characterized by collector 64 and collector actuator subassembly 80 that operative supports same, full details as to the latter as per FIG. 7. Collector 64 is adapted to effectuate select two dimensional clamping in relation to articles collected by the collector during direction of collector assembly 60 from article collection locus 22 to collected article loading locus 34.

Functionally, the collector is intended to sequentially receive articles at the article collection locus in furtherance of establishing at least a single article stack, to retain the established article stack while the collector is directed toward the collected article loading locus, and to off-load the retained article stack at the collected article loading locus in furtherance of top load case packing. In relation to the stated functionality, preferred non-limiting operative configurations or states for the collector are enabled by structures of each of the collector and the collector actuator assembly and relationships for, between, and/or among such structures, such configurations appreciated after a discussion of collector assembly structures, and with later reference to FIGS. 8-10.

With continued reference to FIGS. 4-6, collector 64 of article collection assembly 60 advantageously includes opposingly paired lateral members 66, 66', a top member 68, and article support shelving 70 (FIG. 6), which may be part and parcel of collector actuator subassembly 80 as shown, or which may be part and parcel of one or both of lateral members 66, 66'. As will be appreciated as this discussion proceeds, while all members of the illustrated collector are actuatable, the assembly may be readily adapted such that only one of the two lateral members are actuatable. Notionally, the lateral members may be selectively drawn together/apart to alter a spacing therebetween (i.e., a width dimension for the collector), with the collector top member capable of select lowering/raising to alter a length (i.e., height) dimension of the collector, and pivoting in furtherance of facilitating article ingress as will be later taken up.

Each of lateral members 66, 66' of collector 64 advantageously but not necessarily includes a side panel 72 and a base forming panel 74 extending from a lowermost margin 76 thereof (FIGS. 5 & 6). As should be readily appreciated with reference to FIG. 6, base forming panels 74, 74' shinglingly unite to form a collector base or floor for support of an article and subsequent collection of articles. Be that as it may, the collector structure may be readily adapted to include a discrete base/floor member, or portions thereof, the floor member likewise being actuatable, alone or in combination with the top collector member, in furtherance of aiding article ingress to the collector and/or retention of a collected article group, as per either or both of the other members of the collector.

Lateral members 66, 66' are advantageously change parts, and thus advantageously, but not necessarily, further include a wall segment (i.e., a rear upstanding wall segment) or spine 78 which is adapted (FIG. 6) for swift and sure cooperative union with a portion of collector actuator subassembly 80, e.g., lateral carriage member brackets 81 as shown (FIGS. 5 & 6), via a compression/cam lock fitting 83 or the like (FIGS. 5 & 6).

The collector actuator subassembly of the collector assembly operatively supports the members of the collector. As will be subsequently detailed with reference to FIG. 7, the collector actuator subassembly is notionally characterized by collector member carriages, carriage guides upon which the carriages travel, and linear actuators which permit reversible travel of the collector member carriages along the carriage guides.

Figure 7:
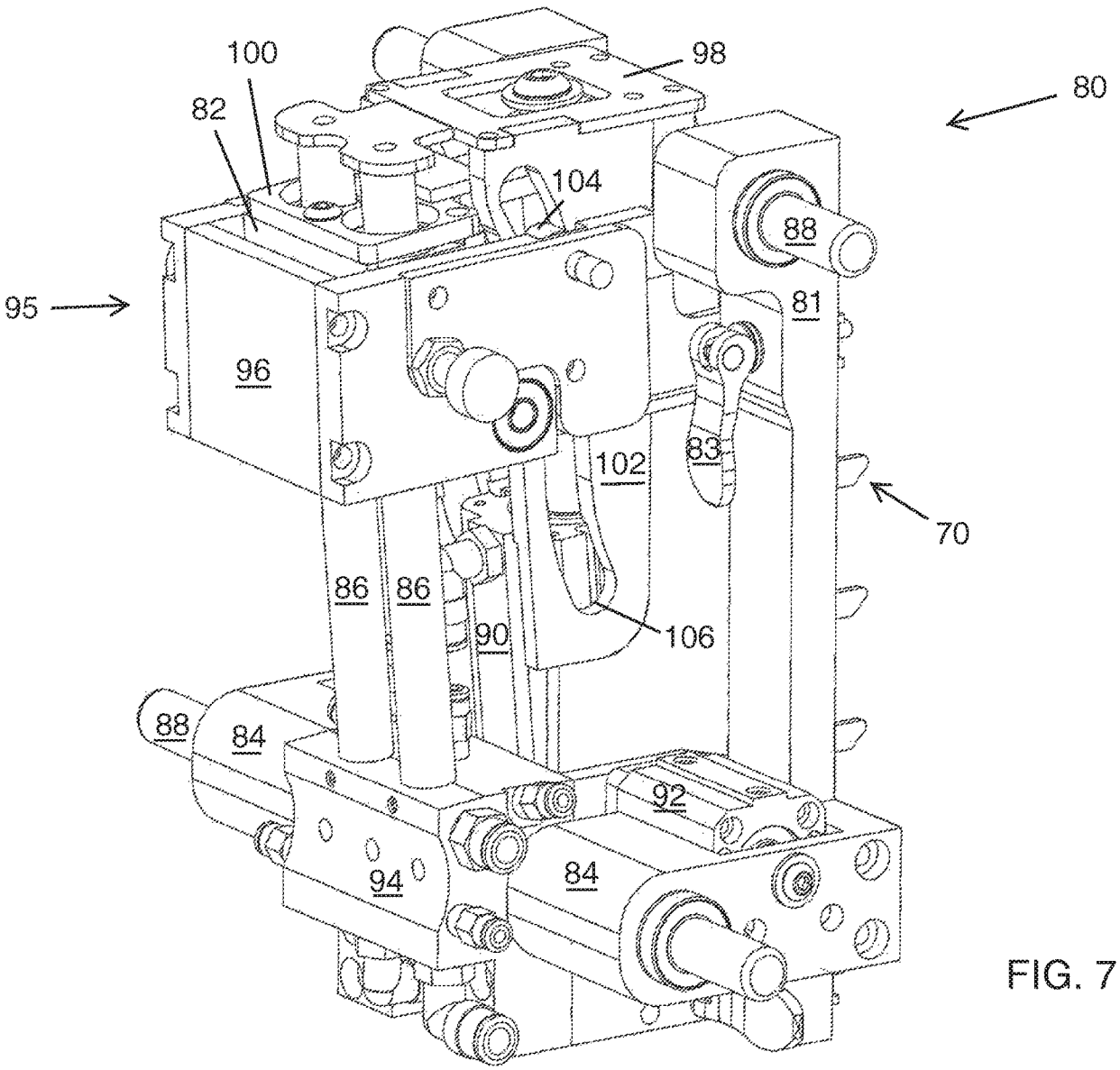
FIG. 7 illustrates a preferred, non-limiting collector actuator subassembly of the contemplated article collector assembly.

With particular reference to FIG. 7, there is illustrated a preferred non-limiting collector actuator subassembly. As the instant subassembly is generally shown, parts omitted for the sake of clarity, in FIGS. 4-6, select reference may follow to one or more of those figures.

Primary components of the FIG. 7 collector actuator subassembly include, but are not limited to: collector member carriages, more particularly, a top member carriage 82 and paired lateral member carriages 84, 84'; carriage guides, more particularly, top collection member guides 86 and lateral collector member guides 88; linear actuators (i.e., a top collector member carriage actuator 90 and lateral collection member actuators 92) for reversibly positioning a carriage relative to the guide to effectuate collector member motions; a subassembly body 94, adapted to support carriage guides 86, 88 and linear actuators 90, 92, for uniting subassembly 80 with robotic arm 50; and, a pivot bracket 96, carried by top member carriage 82 to effectuate an upper limit pivot opening of top collector member 68. Discussion of particulars next proceeds in connection to actuation function, namely, lateral collection member actuation followed by top collection member actuation.

Each lateral collection member 66, 66' is advantageously, but not necessarily, reversibly affixable to its corresponding lateral member carriage 84, 84' via cam lock fitting 83 (FIGS. 4, 5 & 7). Lateral member carriage 84 is slidingly received upon upper and lower carriage guides 88 for translation with respect thereto, the carriage adapted to receive same, the upper guide passing through a portion of the carriage comprised of lateral member bracket 81 (see especially FIGS. 5 & 7). Linear actuator 92 is interposed between a lower portion of subassembly body 94 and lateral member carriage 84, proximal to lower guide 88 (compare FIGS. 5 & 7), such that lateral member carriage 84, and thus lateral collection member 66 united thereto, is selectively translatable.

Top collection member 68 generally extends from top member carriage 82 to which it is affixed (FIG. 4-6). More particularly, spaced apart legs 69 of top collector member 68 (FIG. 6) receive an upper portion of subassembly body 94 and top member carriage 82, the free end portion of leg 69 united with top member carriage 82 as best seen with reference to FIG. 5. Each leg 69 includes a cutout or the like, namely, an upper notch 71 within which the upper lateral member carriage guide is receivable, and a lower or depending groove 73.

Top member carriage 82 is slidingly received upon top member carriage guides 86 for translation with respect thereto, the carriage adapted to receive same (FIGS. 4, 5 & 7). Top member carriage guides 86 upwardly extend from the lower portion of subassembly body 94 and towards an upper portion of same, e.g., a top plate 98 thereof. Linear actuator 90 is interposed between the lower portion of subassembly body 94, intermediate laterally extending linear actuators 92, 92' (FIG. 7), and top member carriage 82, indirectly via a link plate 100 extending forward from an upper surface of top member carriage 82 (FIG. 5), such that top member carriage 82, and thus top collection member 68 united thereto, is selectively translatable.

Top collection member is advantageously, but not necessarily, pivotable, in addition to being translatable, so as to enhance article ingress at the article collection locus. While not shown, one or both of the lateral collector members may be readily adapted to pivot to similarly enhance article ingress.

Pivot motion for the top collection member is effectuated via a pivot linkage 95 which unites top collection member 68 to/with the translatable top member carriage 82. Pivot linkage 95 is generally and fairly characterized by pivot bracket 96, supported by top member carriage 82, and a portion of a sidewall of subassembly body 94, namely, a portion characterized by a grooved/channeled plate 102 (FIG. 7). Top member carriage 82 and a portion of subassembly body 94 are generally received within pivot bracket 96, the pivot bracket equipped with a inwardly extending stud 104 or the like, stud 104 receivable within a groove 106 of grooved plate 102 (FIG. 7). Via such track/track follower arrangement, raising of top member 82 carriage causes an initial raising of top collector member 82 followed by pivoting of pivot linkage 95 owing to track follower 104 entering into an uppermost arcuate segment of groove 106 of grooved plate 102 (compare FIGS. 5 & 7).

With reference now to FIGS. 8-10, an overview of the advantageous functional configurations of a "working" article collector assembly as per FIGS. 4-7 is provided. As to the illustrated sequence, the FIG. 8 assembly is collecting articles at the article collecting locus, the FIG. 9 assembly is retaining the article group in furtherance of a departure from the article collecting locus, and the FIG. 10 assembly is returning to the article collecting locus having off-loaded the article group to the case.

In advance of or by the time of article collecting locus approach (i.e., at time interval before that depicted in FIG. 8 and after that depicted in FIG. 10), all linear actuators are at a relative maximum extension; lateral member carriages 84 are maximally spread one from another, top member carriage 82 is at its maximum height, with pivot linkage 95 in a pivoted or tilted orientation owing to track follower 104 having moved in a downstream direction while upwardly traveling in track 106 of grooved plate 102. As is appreciated, the cross sectional article ingress for the collector is thus at a maximum, thereby greatly facilitating sequential article ingress, either singles or multiples. Moreover, the function of article support shelving 70 should be readily appreciated in the instant view, namely, articles entering collector 64 are thereby forwardly supported (i.e., at their downstream most end), and, as collector 64 is indexingly lowered for receipt of the "next" article, the spatial relationship for, between and among articles of the collected article group is maintained.

Upon receipt of the "last" article making up the article group by the collector, all linear actuators are at a relative minimum extension for the article subject of processing (FIG. 9); lateral member carriages 84 are drawn together to capture the article group transversely (i.e., side to side), top member carriage 82 is at its minimal height to capture the article group top-to-bottom, with pivot linkage 95 orientated substantially perpendicular to top member carriage guides 86 owing to track follower 104 having no/limited down/upstream directional motion while descending in track 106 of grooved plate 102.

Finally, upon travel from article collection locus 22 to collected article loading locus 34, registration of collector 64 with the opening of case 32, and entry of case 32 by collector 64, all linear actuators are at an intermediate extension (FIG. 10); lateral member carriages 84 are drawn apart to release the article group transversely (i.e., side to side), top member carriage 82 having risen from its minimal height to release the article group top-to-bottom, with pivot linkage 95 orientated substantially perpendicular to top member carriage guides 86 owing to track follower 104 having no/limited down/upstream directional motion while ascending in track 106 of grooved plate 102.

Turning now to the sequence of FIGS. 11-14, an overview of advantageous, non-limiting robotic arm functionality is provided.

Figure 11:
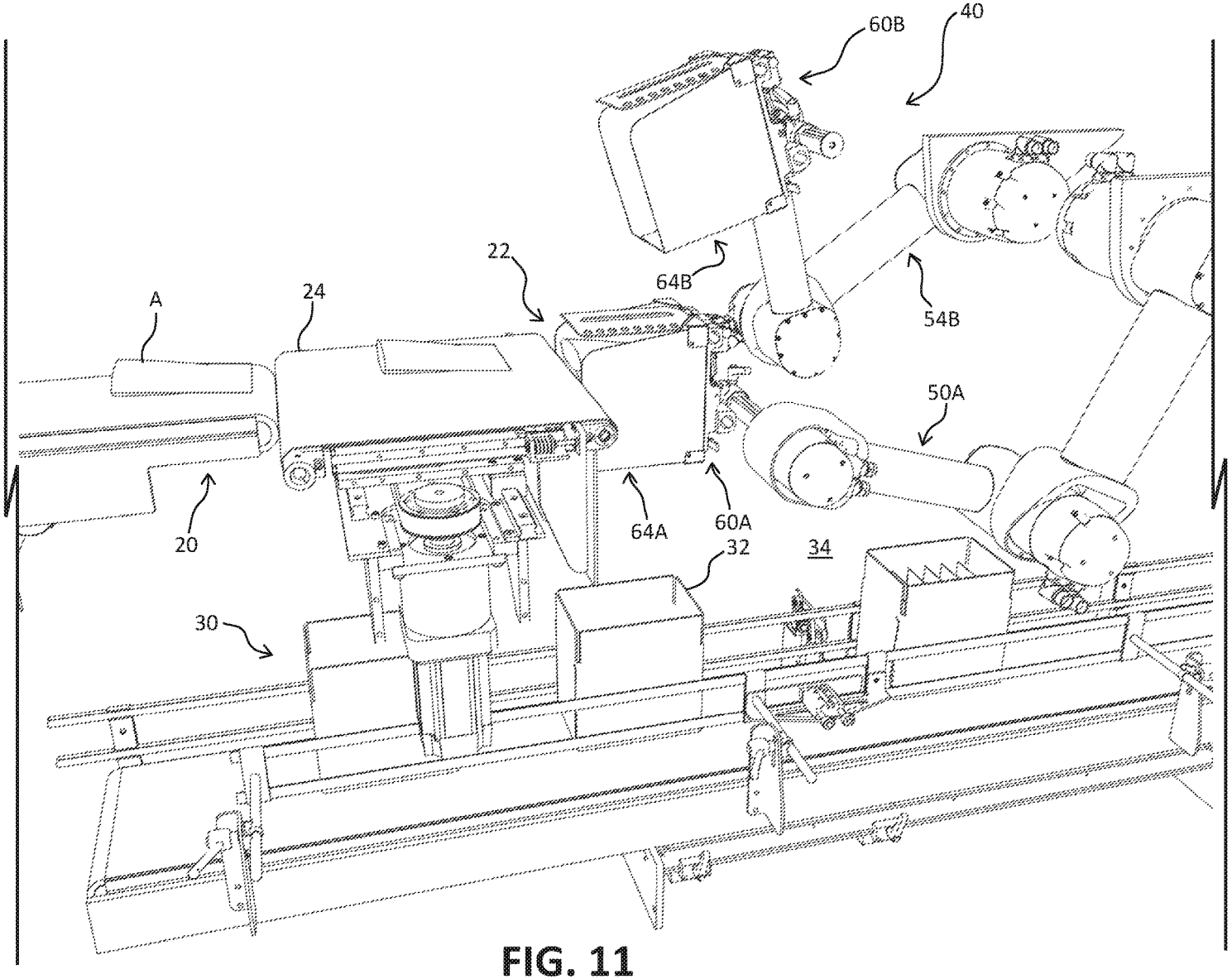
FIG. 11 depicts top loading operations of the assembly of FIG. 2, process flow left to right, namely, article collection at an article collection locus via collector "A," collector approaching the article collection locus.
Figure 12:
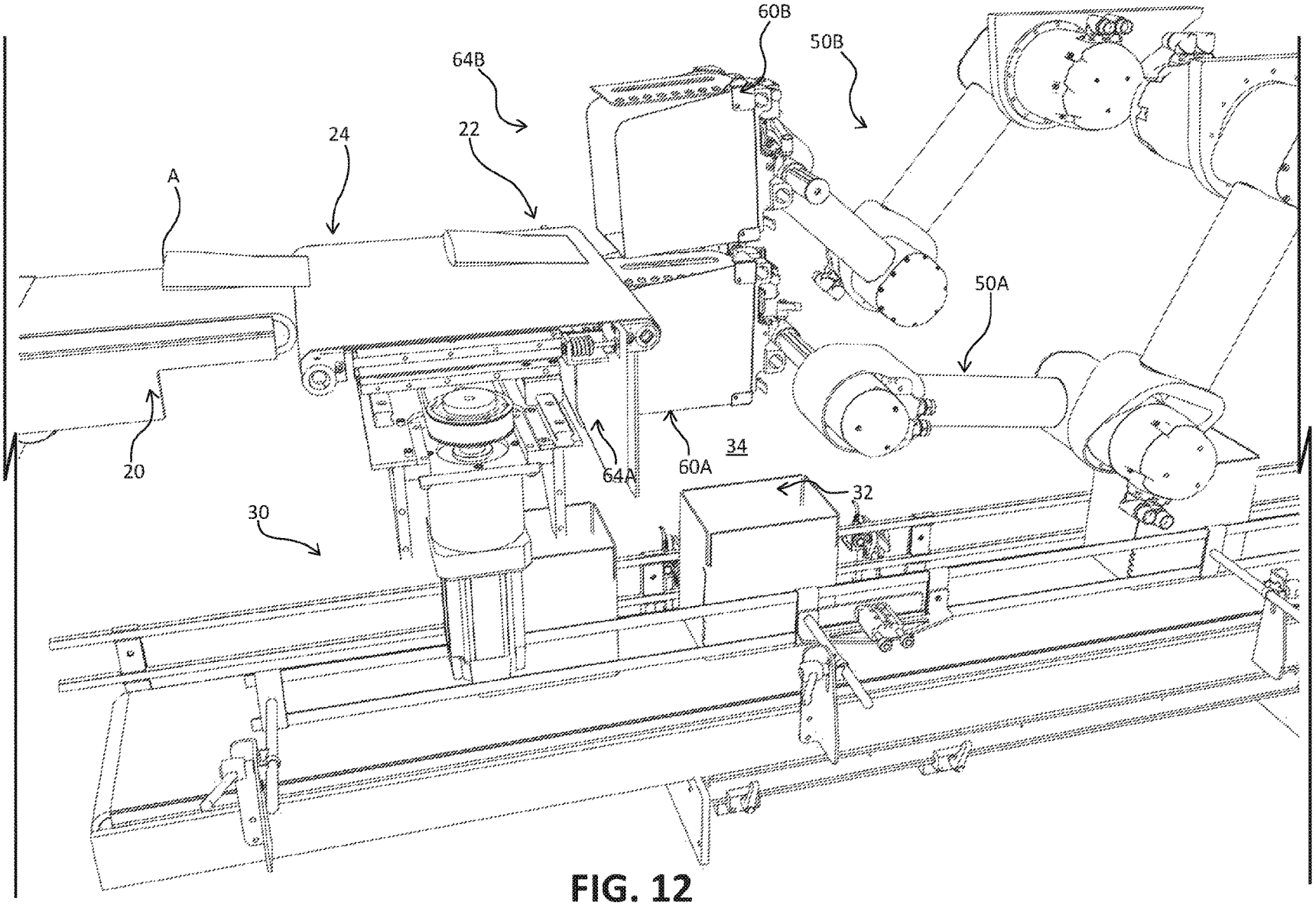
FIG. 12 depicts the operation of FIG. 11 at a later time, collector A clampingly engaging a collected article group during departure from the article collection locus, collector B advancing for article collection.
Figure 13:
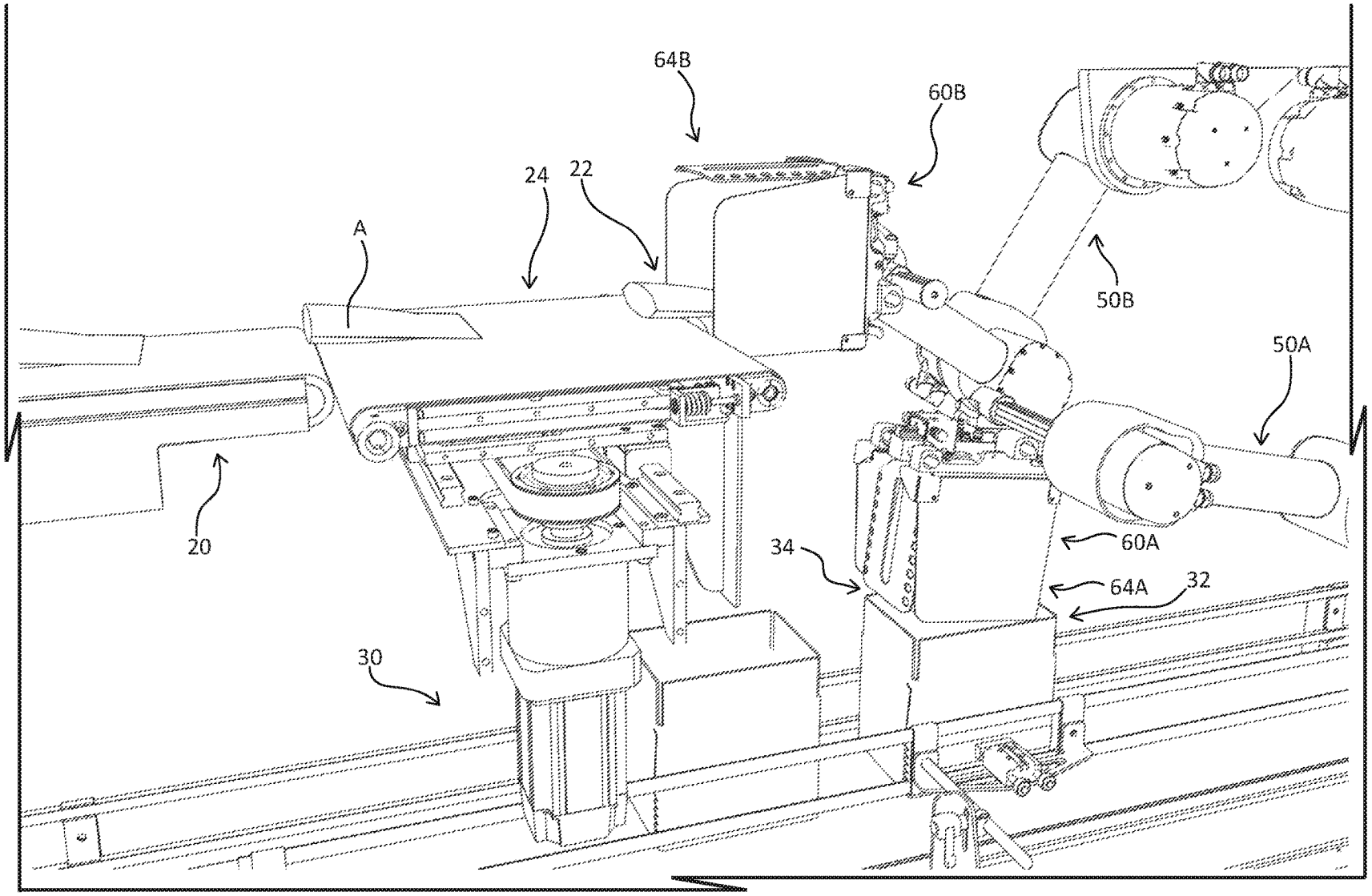
FIG. 13 depicts the operation of FIG. 12 at a later time, collector A approaching a collected article loading locus, collector B collecting at the article collection locus.
Figure 14:
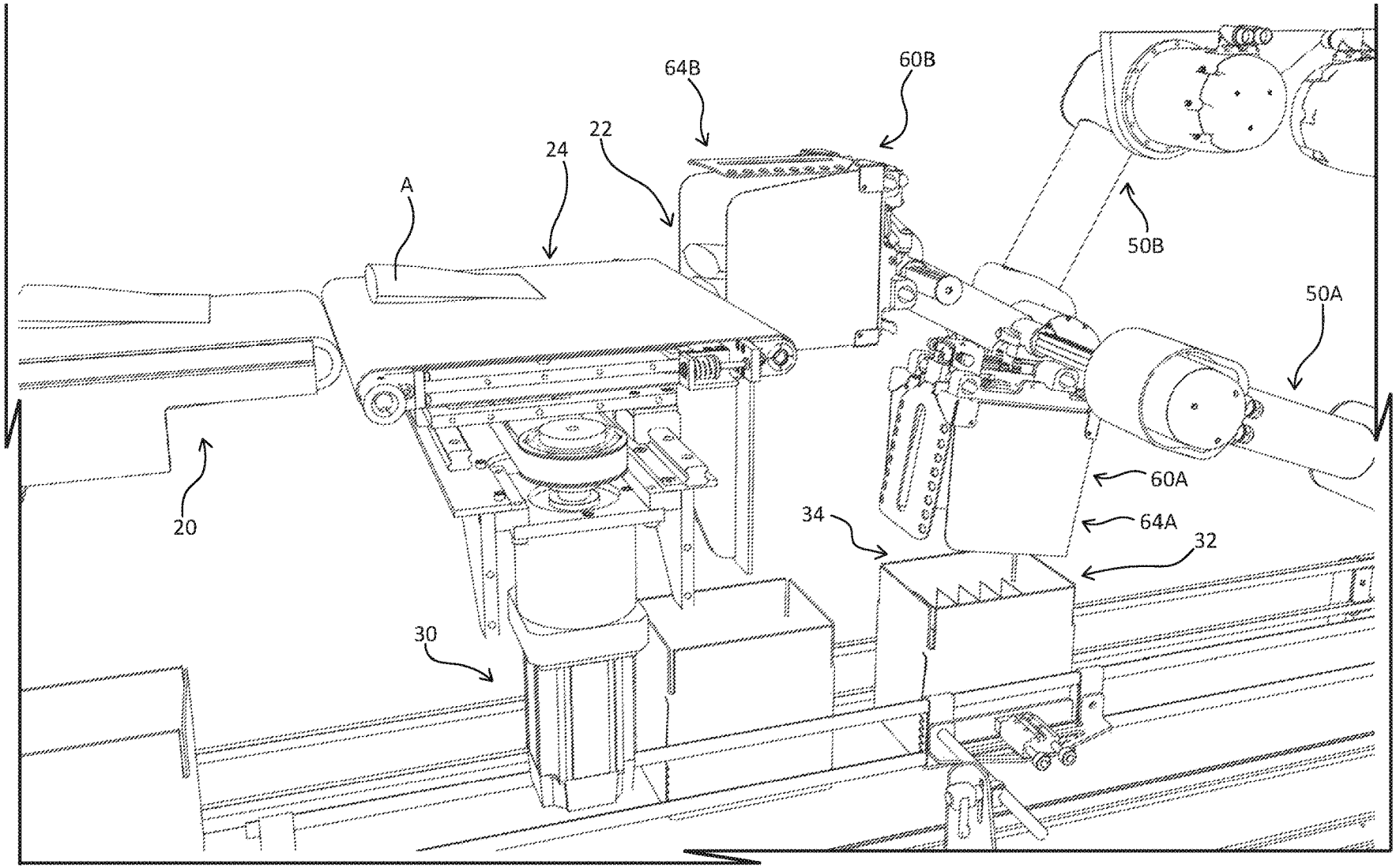
FIG. 14 depicts the operation of FIG. 13 at a later time, collector A departing from collected article loading locus having released the collected articles to a case, collector B collecting at the article collection locus.

As per FIG. 11, articles approach article collection locus 22 in furtherance of sequential receipt of same via collector 64A of robotic arm 50A. As previously noted, collector 64A is fairly characterized as having a maximum article ingress area at this local to aid article collection. Meanwhile, collector 64B of robotic arm 50B has commenced its descent towards article collection locus 22, its article ingress area being at a maximum, or the article collection assembly 60A thereof ready for configuration to effectuate same. Thereafter (FIG. 12), 2D grasping or clamping is effectuated for filled collector 64A, collector 64B completing its approach to article collection locus 22. As collector 64B commences collection of articles at article collection locus 22, collector 64A completes its approach to collected article loading locus 34, and is ready for descent into open case 32 for off-loading the article group via release of the 2D clamping of same. Finally, with collector 64B nearing completion in relation to its collecting function, collector 64A has since released and off-loaded the article group to underlying case 32, article collector assembly 60A thereof maintaining its release configuration during upward return travel of same.

Referring now, and finally, to FIGS. 15 & 16, there is depicted advantageous, non-limiting travel paths for the article collector assembly of the contemplated top loading assembly. As per FIG. 15, robotic arm 50 is actuatable to effectuate a convex upper upstream travel segment 111 for collector assembly 60 during an approach to article collection locus 22. As per FIG. 16, robotic arm 50 is actuatable to effectuate a concave upper upstream travel segment 113 for collector assembly 60 during an approach to article collection locus 22. Of particular note is the article collector assembly 60 approach in relation to article collection locus 22, for instance, in respect of the travel path of FIG. 16, the approach angle of collector 64 is such that a leading edge of floor 115 thereof arrives at article collection locus 22 so as to be below the egress point of articles received from the article infeed. In as much as article gapping and metered flow regulation support improved article quantity through put, improved approach angles further aide same and minimize downtime for mis-collected article and the like.

While advantageous, non-limiting systems, apparatus, devices, mechanisms, methods, etc. relating to article collection, secured location of a collected article group and top loading of same, are depicted, described and/or readily ascertained with reference to the instant disclosure, alternate not insubstantial functional equivalents are likewise contemplated to effectuate a sought after quick, secure, reliable top loading for conveyed articles. Presently known and future developed means for effectuating the noted functionalities are understood to be within the scope of the instant disclosure.

Thus, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

The invention claimed is:

1. A top loading assembly comprising a selective compliance assembly robotic arm, an article collector assembly supported thereby for positioning in two dimensional space, and a frame from which said selectively compliance assembly robotic arm extends, said selective compliance assembly robotic arm characterized by first and second arm segments and three pivotable arm joints, a first arm joint J1 being a terminal/anchorable arm joint, a second arm joint J2 being an intermediate arm joint, and a third arm joint J3 being a distal arm joint for operatively supporting said article collector assembly, said first arm segment extending between J1 & J2, said second arm segment extending between J2 & J3, said article collector assembly directable from an article collection locus to a collected article loading locus, said collected article loading locus being co-planar with said article collection locus, said article collector assembly comprising a collector-adapted to effectuate select clamping in relation to articles collected by said collector during direction of said article collector assembly from said article collection locus to said collected article loading locus.

2. The top loading assembly of claim 1 wherein J1 is a downstream most arm joint.

3. The top loading assembly of claim 1 wherein J2 is a downstream most arm joint.

4. The top loading assembly of claim 1 wherein J2 is in an elevated condition relative to J1.

5. The top loading assembly of claim 1 wherein J2 is in an elevated condition relative to J1 during article collection by said collector at said article collection locus.

6. The top loading assembly of claim 1 wherein J1 is in substantial elevational alignment with said article collection locus.

7. The top loading assembly of claim 1 wherein said selective compliance assembly robotic arm is actuatable to effectuate a convex upper upstream travel segment for said collector of said collector assembly during an approach to said article collection locus.

8. The top loading assembly of claim 1 wherein said selective compliance assembly robotic arm is actuatable to effectuate a concave upper upstream travel segment for said collector of said collector assembly during an approach to said article collection locus.

9. The top loading assembly of claim 1 further comprising a collector actuator subassembly, said collector selectively actuatable via said collector actuator subassembly in furtherance of effectuating select clamping of a collected article group.

10. The top loading assembly of claim 1 further comprising a collector actuator subassembly, said collector selectively actuatable via said collector actuator subassembly in furtherance of effectuating select two dimensional clamping of a collected article group.

11. The top loading assembly of claim 1 wherein said article collector assembly includes dual clamps and a clamp base characterized by clamp actuators for actuating said dual clamps, said dual clamps delimiting said collector.

12. The top loading assembly of claim 1 wherein said article collector assembly includes dual clamps and a clamp base characterized by clamp actuators for actuating said dual clamps, said dual clamps delimiting said collector, said dual clamps adapted as change parts so as to be readily substituted for in furtherance of alternately configuring and/or dimensioning a collector so delimited thereby.

13. The top loading assembly of claim 1 wherein said collector includes a side clamp to effectuate side-to-side article group clamping and a top clamp to effectuate top-to-bottom article group clamping.

14. The top loading assembly of claim 1 wherein said collector includes a side clamp to effectuate side-to-side article group clamping and a top clamp to effectuate top-to-bottom article group clamping, said top clamp adapted for pivoting to enhance article ingress to said collector.

15. The top loading assembly of claim 1 wherein said collector includes a side clamp to effectuate side-to-side article group clamping and a top clamp to effectuate top-to-bottom article group clamping, said side clamp adapted for pivoting to enhance article ingress to said collector.

16. The top loading assembly of claim 1 wherein said collector includes a surface adapted to retain ends of articles collected therein in a spaced apart condition.

17. The top loading assembly of claim 1 wherein said collector includes opposingly paired lateral members and a top member, said members delimiting an adjustable article receiving volume.

18. The top loading assembly of claim 1 wherein said collector includes opposingly paired lateral members and a top member, said members delimiting an adjustable article receiving volume, said lateral members of said opposingly paired lateral members being change parts.

19. The top loading assembly of claim 18 further comprising a collector actuator subassembly, said collector actuator subassembly operatively linked to at least one lateral member of said opposingly paired lateral members to effectuate translation thereof.

20. The top loading assembly of claim 18 further comprising a collector actuator subassembly, said collector actuator subassembly operatively linked to each lateral member of said opposingly paired lateral members to effectuate translation thereof.

21. The top loading assembly of claim 18 further comprising a collector actuator subassembly, said collector actuator subassembly operatively linked to said top member to effectuate translation thereof.

22. The top loading assembly of claim 18 further comprising a collector actuator subassembly, said collector actuator subassembly operatively linked to said top member to effectuate translation and pivoting thereof.

23. The top loading assembly of claim 18 further comprising a collector actuator subassembly, said collector actuator subassembly operatively linked to one or both of said opposingly paired lateral members to effectuate translation and pivoting thereof.

24. The top loading assembly of claim 18 further comprising a collector actuator subassembly, said collector actuator subassembly operatively linked to said lateral side members and said top member to effectuate select translations of same in furtherance of two dimensional clamping of a collected article group.

25. A method of case loading articles comprising the steps of:

a. directing articles of an article infeed supply to an article collection locus;

b. providing a case loading assembly proximal to said article collection locus, said case loading assembly comprising a selective compliance assembly robotic arm, an article collector assembly supported thereby, and a frame from which said selectively compliance assembly robotic arm extends, said selective compliance assembly robotic arm characterized by first and second arm segments and three pivotable arm joints, said article collector assembly directable from said article collection locus to a collected article loading locus, said collected article loading locus being co-planar with said article collection locus, said collector assembly comprising a collector adapted to effectuate select clamping in relation to articles collected by said collector;

c. collecting articles via said collector of said article collector assembly at said article collection locus, a portion of said collector having been actuated to enhance article ingress into said collector; and, d. retaining a collected article group within said collector of said article collector assembly, portions of said collector having been actuated to effectuate clamping of said collected article group during travel of said article collector assembly from said article collection locus to said collected article loading locus there below.

26. A top loading assembly comprising a selective compliance assembly robotic arm, an article collector assembly supported thereby, and a frame from which said selectively compliance assembly robotic arm extends, said selective compliance assembly robotic arm characterized by first and second arm segments and three pivotable arm joints, a first arm joint J1 being a terminal/anchorable arm joint, a second arm joint J2 being an intermediate arm joint, and a third arm joint J3 being a distal arm joint for operatively supporting said article collector assembly, said first arm segment extending between J1 & J2, said second arm segment extending between J2 & J3, said article collector assembly, directable from an article collection locus to a co-planar collected article loading locus downstream and below said article collection locus, comprising a collector for receiving articles singularly or in multiples, said collector adapted to effectuate select clamping in relation to articles collected by said collector during direction of said article collector assembly from said article collection locus to said collected article loading locus, said selective compliance assembly robotic arm configured so as to extend from said frame such that J3 descends below a frame extension point for the frame extending selectively compliance assembly robotic arm during positioning of said article collector assembly at said collected article loading locus.

27. A top loading assembly comprising synchronously operable paired selective compliance assembly robotic arms, each arm of the synchronously operable paired selective compliance assembly robotic arms including an article collector assembly supported thereby, and a frame from which said paired selectively compliance assembly robotic arms extends, each robotic arm of said synchronously operable paired selective compliance assembly robotic arms characterized by first and second arm segments and three pivotable arm joints, a first arm joint J1 being a terminal/anchorable arm joint, a second arm joint J2 being an intermediate arm joint, and a third arm joint J3 being a distal arm joint for operatively supporting said article collector assembly, said first arm segment extending between J1 & J2, said second arm segment extending between J2 & J3, said article collector assembly, directable from an article collection locus to a co-planar collected article loading locus downstream and below said article collection locus, comprising a collector adapted to effectuate select clamping in relation to articles collected by said collector during direction of said article collector assembly from said article collection locus to said collected article loading locus, each synchronously operable paired selective compliance assembly robotic arm of said synchronously operable paired selective compliance assembly robotic arms configured so as to extend from said frame such that J3 descends below a frame extension point for each frame extending selectively compliance assembly robotic arm during positioning of said article collector assembly at said collected article loading locus.

* * * * *